US007216687B2

(12) United States Patent
Franssen

(10) Patent No.: US 7,216,687 B2
(45) Date of Patent: May 15, 2007

(54) CORD TENSIONER

(75) Inventor: Johannes Robertus Maria Franssen, Breda (NL)

(73) Assignee: Hunter Douglas Industries BV, El Rotterdam (NL)

( * ) Notice: Subject to any disclaimer, the term of this patent is extended or adjusted under 35 U.S.C. 154(b) by 168 days.

(21) Appl. No.: 10/970,896

(22) Filed: Oct. 22, 2004

(65) Prior Publication Data

US 2005/0101456 A1 May 12, 2005

(30) Foreign Application Priority Data

Oct. 24, 2003 (EP) ..... 03078359

(51) Int. Cl.
*E06B 3/48* (2006.01)

(52) U.S. Cl. ..... 160/84.06; 160/279

(58) Field of Classification Search ..... 160/84.06, 160/84.01, 84.04, 84.05, 172 R, 279; 267/73, 267/74, 170, 174, 179
See application file for complete search history.

(56) References Cited

U.S. PATENT DOCUMENTS

| | | | | | |
|---|---|---|---|---|---|
| 290,688 | A | * | 12/1883 | Johnson | 59/83 |
| 428,868 | A | * | 5/1890 | Stoakes et al. | 54/73 |
| 556,729 | A | * | 3/1896 | Baumgarten | 24/50 |
| 597,596 | A | * | 1/1898 | Walker | 267/74 |
| 810,146 | A | * | 1/1906 | Hogan | 267/72 |
| 821,295 | A | * | 5/1906 | Karr | 5/194 |
| 830,320 | A | * | 9/1906 | Henry | 5/199 |
| 950,952 | A | | 3/1910 | Perrott | |
| 1,331,201 | A | * | 2/1920 | Fowler et al. | 267/74 |
| 2,830,808 | A | | 4/1958 | Graber | |
| 3,112,103 | A | | 11/1963 | Falkenberg | |
| 3,151,857 | A | | 10/1964 | Falkenberg | |
| 3,294,153 | A | | 12/1966 | Fountain | 160/168 |
| 3,590,900 | A | | 7/1971 | Salzmann | 160/126 |
| 3,633,646 | A | | 1/1972 | Zilver | 160/168 |
| 3,945,264 | A | | 3/1976 | Falkenberg | |
| 4,473,101 | A | | 9/1984 | Langeler | |
| 4,557,309 | A | | 12/1985 | Judkins | |
| 4,593,737 | A | * | 6/1986 | Clemente | 160/84.06 |
| 4,601,131 | A | | 7/1986 | Ozols | |
| 4,732,202 | A | | 3/1988 | Anderson | 160/168.1 |
| 4,733,711 | A | | 3/1988 | Schon | |
| 4,762,159 | A | * | 8/1988 | Ford | 160/84.06 |
| 4,811,466 | A | | 3/1989 | Zubli | 24/115 G |
| 4,825,929 | A | | 5/1989 | Haines | |
| 4,850,414 | A | * | 7/1989 | Lessard | 160/84.02 |
| 5,168,913 | A | | 12/1992 | Haines | 160/168.1 |
| 5,275,222 | A | | 1/1994 | Jelic et al. | 160/178.2 |
| 5,533,559 | A | * | 7/1996 | Judkins | 160/84.06 |
| D377,287 | S | | 1/1997 | Biba | D6/581 |

(Continued)

FOREIGN PATENT DOCUMENTS

| | | |
|---|---|---|
| EP | 0 699 268 | 1/1997 |

(Continued)

*Primary Examiner*—David Purol
(74) *Attorney, Agent, or Firm*—Dorsey & Whitney LLP

(57) ABSTRACT

A cord tensioner for the guide cords of a cord-guided window blind with movable rails holding a blind material. The cord tensioner, located at one of the rails, is a helically wound, extension spring with an integral extension limiter, extending axially through the spring, to prevent it from being overextended.

21 Claims, 2 Drawing Sheets

U.S. PATENT DOCUMENTS

| | | | | |
|---|---|---|---|---|
| 5,752,558 | A | 5/1998 | Lin | |
| D395,973 | S | 7/1998 | Huang | D6/581 |
| 5,845,696 | A | 12/1998 | Chou | 160/178.1 V |
| 5,904,198 | A | 5/1999 | Huang | 160/168.1 R |
| D428,292 | S | 7/2000 | Anderson | D6/581 |
| 6,098,970 | A | 8/2000 | Lowe | 267/179 |
| 6,644,373 | B2 * | 11/2003 | Palmer | 160/168.1 R |
| 6,792,999 | B2 | 9/2004 | Cross et al. | |
| 7,108,038 | B2 * | 9/2006 | Welfonder | 160/84.06 |
| 2004/0159410 | A1 | 8/2004 | Welfonder | |

FOREIGN PATENT DOCUMENTS

| | | |
|---|---|---|
| EP | 1 447 516 A2 | 8/2004 |
| GB | 381894 | 10/1932 |
| GB | 2050 560 A | 1/1981 |
| JP | 60-88779 | 5/1985 |
| WO | WO 94/28279 A1 | 12/1994 |
| WO | WO 99/55553 | 11/1999 |

* cited by examiner

CORD TENSIONER

CROSS REFERENCE TO RELATED APPLICATION

This application claims priority to European patent application No. 03078359.1, filed 24 Oct. 2003, which is hereby incorporated by reference as if fully disclosed herein.

BACKGROUND OF THE INVENTION

1. Field of the Invention

This invention relates to a cord tensioner for a cord-guided covering, such as a roller blind, pleated blind or venetian blind or a combination of such blinds, for an architectural opening, such a vertical or a slanted window (e.g., a roof window).

2. Description of the Relevant Art

Cord tensioners have been conventionally used to keep guide cords of window coverings taut. Tensioned guide cords have been particularly important in coverings for slanted roof windows to prevent the fabrics and slats of the window coverings from sagging downwardly away from the windows. Cord tensioners have served to keep movable head rails, intermediate rails or bottom rails from sliding, under their own weight, down the guide cords. In this regard, the cord tensioners have maintained sufficient tension in the guide cords, so that there is enough friction between the guide cords and the movable rails to prevent the rails from sliding down the guide cords.

Cord tensioners for window coverings have traditionally been made from common tension springs as described in U.S. Pat. No. 4,733,711 and U.S. Pat. No. 4,557,309. However, such tension springs can be easily over stretched, particularly when movable rails of their window coverings are moved up or down abruptly. This is because the tension springs will bear any sudden force exerted on the guide cords before the movable rails slide along the guide cords. Any over stretching of the tension springs will reduce the tension in the guide cords and may make it necessary to retension the guide cords by either stretching the tension springs further or replacing them.

Tension springs have been protected against being over stretched by providing a cord between the two ends of each spring, so that the cord has a length less than the maximum allowable stretch of the spring along its axis. A problem with this solution is that the cord must always be too long for the spring in normal use, and the excess length of the cord can easily become snagged between the coils of the spring.

SUMMARY OF THE INVENTION

In accordance with this invention, a cord tensioner is provided for tensioning a guide cord of a cord-guided covering which has an upper rail, a lower rail and a blind material extending between the upper and lower rails and in which the upper rail, the lower rail or both are movable along the guide cord; the cord tensioner being positioned at, preferably in, the upper or lower rail; and the cord tensioner being a helically wound, extension spring that includes an axially stretchable, first spring body and an extension limiter to prevent the first spring body from being stretched further axially than a predetermined length; and wherein the extension limiter is integrally formed with the first spring body.

Advantageously, the extension limiter of the cord tensioner is rigid to prevent it from being snagged between coils of the first spring body. It is also advantageous, for ease and economy of manufacture of the cord tensioner, that the extension limiter is an uncoiled length of a spring wire material, from which the first spring body is also made. It is further advantageous that the extension limiter extends parallel to the axis of, preferably axially through, the first spring body and has a length greater than the unstretched axial length of the first spring body and thus extends beyond the axial length of the first spring body, to guide stretching of the first spring body axially.

It is also advantageous that the extension limiter includes a stem and a blocking member which prevents the spring body from being over stretched. It is further advantageous that the cord tensioner includes a second spring body that is axially spaced away from the first spring body and is also integral with the extension limiter and that each spring body acts as a blocking member for the opposite spring body. It is still further advantageous that the cord tensioner includes a second spring body that is axially spaced away from the first spring body and is also integral with the extension limiter and that the extension limiter also includes a blocking member between the two spring bodies.

BRIEF DESCRIPTION OF THE DRAWINGS

Further aspects of the invention will be apparent from the detailed description below of particular embodiments and the drawings thereof, in which.

DETAILED DESCRIPTION OF THE PREFERRED EMBODIMENTS

Figure 1:
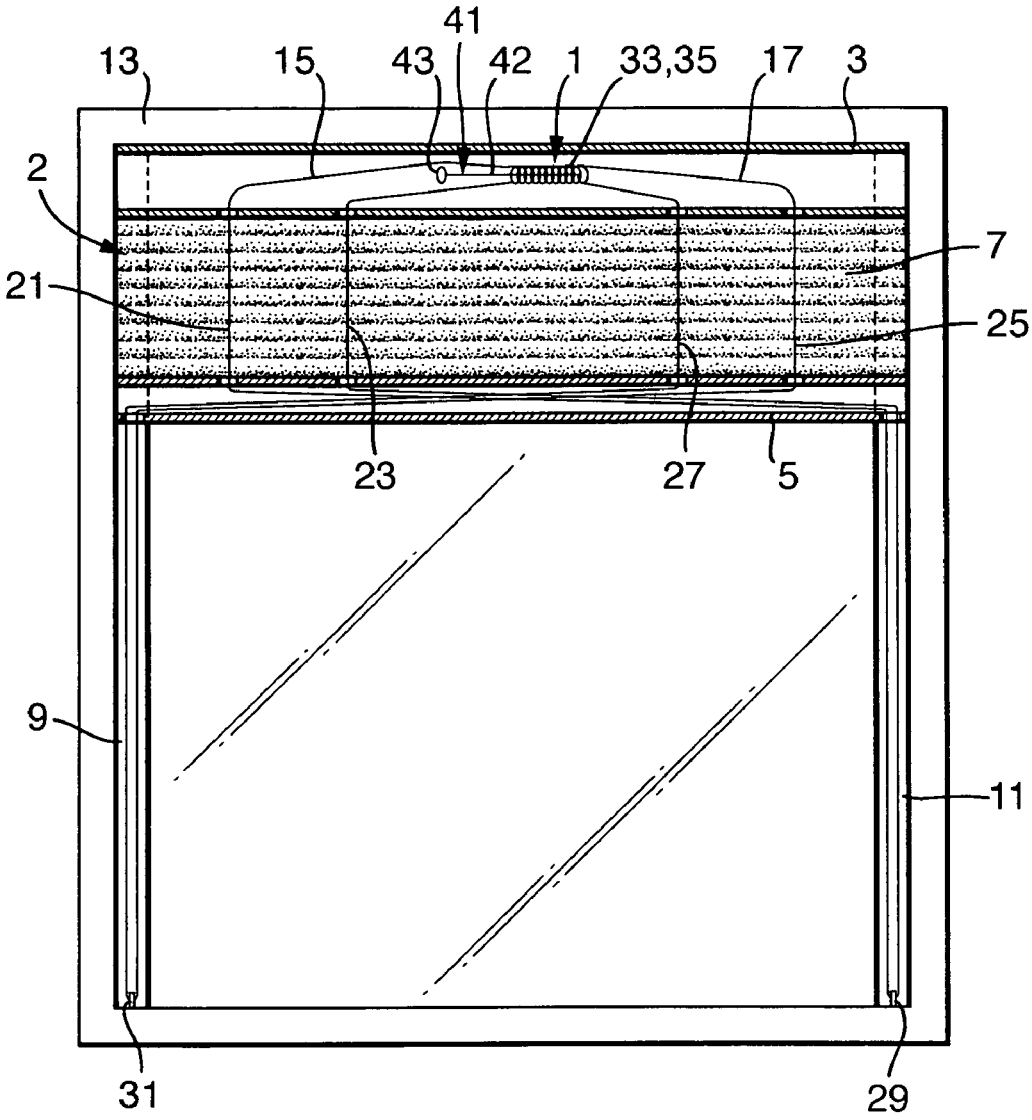
FIG. 1 is a schematic, partially perspective view of a cord-guided pleated blind with a fixed head rail and a movable bottom rail and two looped guide cords; shown in perspective view is a single cord tensioner of a first embodiment of this invention, mounted in the head rail.
Figure 2:
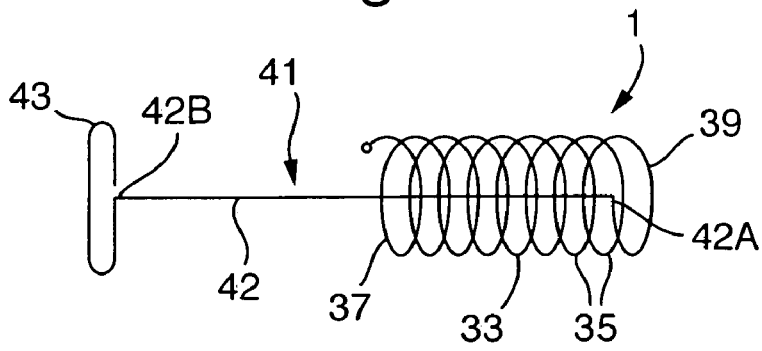
FIG. 2 is a schematic view of the cord tensioner of FIG. 1.

FIGS. 1 and 2 show a first embodiment of a cord tensioner 1 of the invention in an otherwise conventional, cord-guided, pleated blind 2, shown in FIG. 1. The blind 2 has a fixed, longitudinally-extending hollow upper rail or bar 3, a movable, longitudinally-extending hollow lower rail or bar 5, and a pleated blind material 7 extending between the rails 3, 5. The blind 2 also has left and right, vertically-extending, elongated side guides 9, 11 which are perpendicular to, and in front of, the rails 3, 5 and are parallel to, and in front of, left and right, vertically-extending, marginal edges of the blind material 7. The side guides 9, 11 are mounted in a window frame 13 which can be for a slanted roof window. The blind 2 also has left and right, vertically-extending, guide cords 15, 17 which are tensioned with the single cord tensioner 1 in the upper rail 3 and which can therefore hold the lower rail 3 in different vertical positions in the blind.

The blind material 7 can be opened and closed by moving the lower rail 5 vertically along the side guides 9, 11. The blind material 7 has four rows of openings: outer and inner, left rows of openings 21, 23, through which the left guide cord 15 can pass through the blind material, and outer and inner, right rows of openings 25, 27, through which the right guide cord 17 can pass through the blind material. The left and right outer rows 21, 25 are positioned closer to the respective left and right side guides 9, 11 than the left and right inner rows 23, 27.

The cord tensioner 1 is mounted in the upper rail 3. The left guide cord 15 is routed from the head rail 3: downwardly through the blind material 7 through its outermost left row of openings 21 and then to the bottom rail 5. The left guide cord 15 then passes: longitudinally through the bottom rail 5 to the right side guide 11, downwardly and then around a right mounting block 29, upwardly through the right side guide 11, the lower bar 5 and then the inner left row of openings 23, and then back into the upper rail. Similarly the right guide cord 17 is routed from the upper rail 3: downwardly through the blind material 7 through its outermost right row of openings 25 and then to the lower rail 5. The right guide cord 17 then passes: longitudinally through the lower rail 5 to the left side guide 9, downwardly and the around a left mounting block 31, upwardly through the left side guide 9, the lower bar 5 and then the inner right row of openings 27 and then back into the upper rail.

The cord tensioner 1, as shown in detail in FIG. 2, includes a spring body 33. The spring body 33 is preferably a helically-wound extension spring having a plurality of adjacent spring coils 35 wound about its longitudinally-extending axis. The spring body has, at opposite longitudinal ends, a left or inner body end 37 and a right or outer body end 39.

On the left body end 37 of the spring body 33 of the cord tensioner 1 is an extension limiter 41. The extension limiter 41 is preferably formed integrally with the spring body 33 by an unwound or uncoiled length of the same spring material that forms the spring body. The extension limiter includes a stem 42 with a fixed end 42A and a free end 42B. The fixed end 42A of the stem 42 is attached to the outer body end 39 of the spring body, and the stem extends from the fixed end 42A parallel to the axis of, preferably axially through, the spring body 33 and its coils 35, to and beyond the inner body end 37 of the spring body. The cord tensioner 1 is preferably mounted in the upper rail 3, so that the axis of its spring body 33 and its extension limiter 41 extend longitudinally.

On the free end 42B of the stem 42 is a blocking member 43 which is preferably an integrally formed loop or hook-shaped end on the free end 42B. Alternatively, the blocking member 43 can be a separate member, releasably attached to the free end 42B. The blocking member 43 is of a size and shape that prevents the spring body 33 from being stretched longitudinally beyond the blocking member. If the stem 42 is coaxial with the spring body 33, the blocking member 43 should have at least one dimension, transverse to the axis of the spring body, that is larger that the cross-section of the spring coils 35, transverse to the axis of the spring body.

As seen from FIG. 1, the guide cords 15, 17 are connected to the longitudinally opposite ends 37, 39 of the spring body 33 of the cord tensioner 1 in the upper rail, so that the spring body is suspended or floats between the two guide cords. The left guide cord 15 is slidably attached to the left body end 37, and the right guide cord 17 is slidably attached to the outer body end 39, preferably by lacing each guide cord about the last or the last couple of coils 35 of the spring body 33, adjacent each opposite end 37, 39. When one or both of the guide cords 15, 17 exert force longitudinally on the cord tensioner 1, the spring body 33 is stretched longitudinally and axially along the longitudinally-extending extension limiter 41 towards the blocking member 43. However, the blocking member prevents the spring body from being over-stretched, past the blocking member, in case the force of the guide cords is excessive.

The total longitudinal length of the extension limiter 41 from the fixed end 42A of its stem portion 42 to its blocking member 43 is less than the maximum stretched longitudinal length of the spring body 33. Preferably, the length of the extension limiter is such that blocking member 43 prevents the spring body 33 from being stretched beyond a length where its mechanical, particularly elastic, properties would be damaged. This ensures a longer mechanical life of the cord tensioner 1 and the blind 2.

The extension limiter 41 provides a guiding function in its preferred coaxial arrangement with the spring body 33 in the cord tensioner 1. When the spring body 33 is stretched or extended longitudinally and axially by a pulling force of the guide cords 15, 17, the spring body is guided smoothly along the extension limiter 41, thereby providing a smooth operation of the blind 2.

Figure 3:
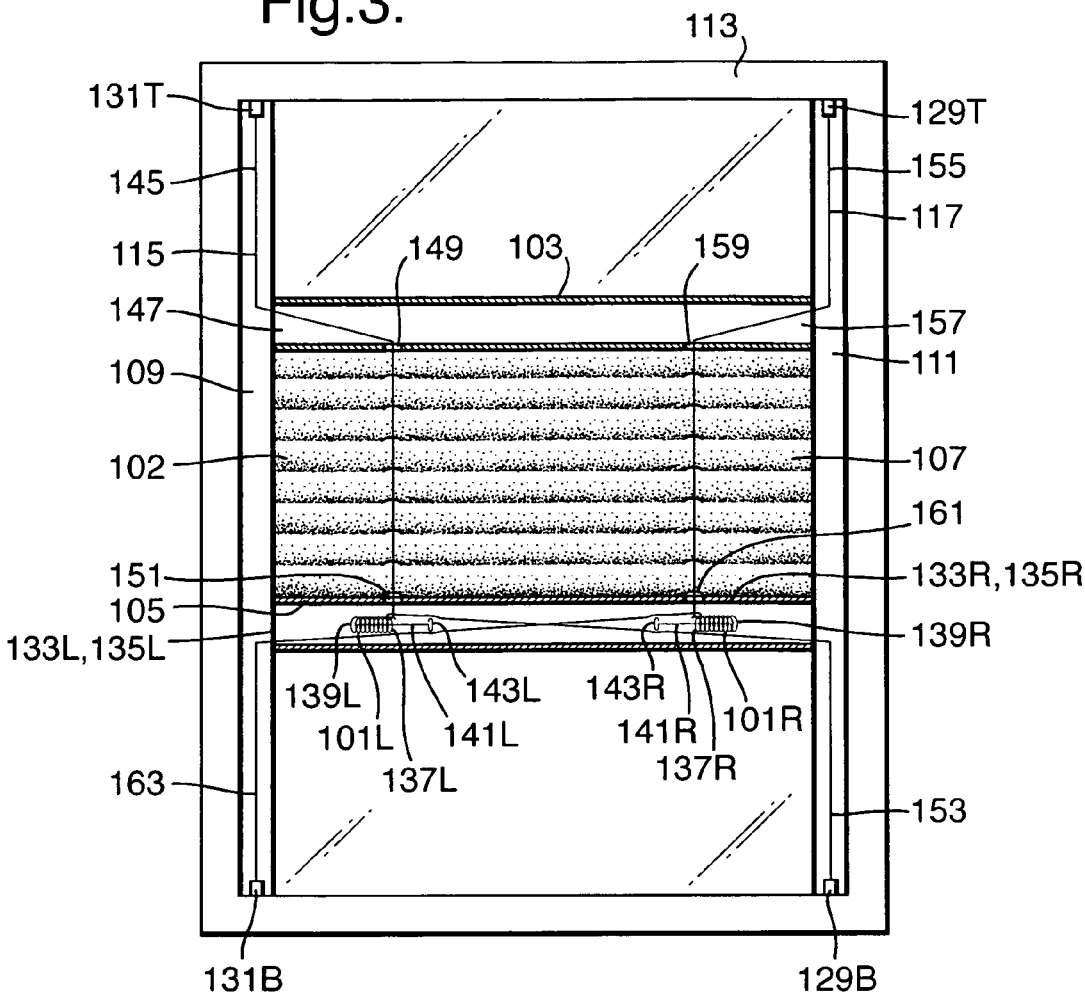
FIG. 3 is a schematic perspective view of a cord-guided pleated blind with two movable rails and two guide cords; shown in cross-section are two cord tensioners of FIGS. 1 and 2, mounted in the lower rail.

FIG. 3 shows a blind 102 which is similar to the blind 2 of FIG. 1 and for which corresponding reference numerals (greater by 100) are used below for describing the same parts or corresponding parts.

The blind 102 has a movable, longitudinally-extending, hollow upper rail or 103, a movable, longitudinally-extending, hollow lower rail 105, and a pleated blind material 107, extending between the rails. The blind 102 also has left and right, side guides 109, 111, mounted in a window frame 113. The blind 102 further has left and right, guide cords 115, 117 which are tensioned with left and right, cord tensioners 101L, 101R, mounted in the lower rail 105. The cord tensioners 101L, 101R each correspond to the cord tensioner 1 of FIG. 2 and can therefore hold the rails 103, 105 in different vertical positions in the blind 102. The blind material 107 can be opened and closed by moving the upper and lower rails 103, 105 vertically along the side guides 109, 111.

The cord tensioners 101L, 101R are preferably fixed by the outer body ends 139R, 139L of their spring bodies 133R, 133L in the lower rail 105 in a conventional manner, such as with a screw or the like. The spring bodies 133R, 133L are preferably helically-wound extension springs, each with a plurality of adjacent spring coils 135L, 135R. The extension limiter 141L, 141R of each cord tensioner 101L, 101R extends along, preferably axially through, its spring body 133L, 133R and its coils 135L, 135R. Each cord tensioner 101L, 101R is preferably mounted in the lower rail 105, so that the axis of its spring body 133L, 133R and its extension limiter 141L, 141R extend longitudinally towards each other. Additionally, the spring bodies 133R, 133L can be fixed by their blocking members 143L, 143R to the lower rail.

The left guide cord 115 is routed through the blind 102 from the top of the left side guide 109 to the bottom of the right side guide 111. A top end 145 of the left guide cord 115 is attached to the top of the left side guide 109 by a top left mounting block 131T, and from there, the left guide cord extends downwardly along, and to the rear of, an upper part of the left side guide 111 and then extends to the right into the open left end of the upper rail 103. Inside the upper rail 103, the left guide cord 115 extends to the right, along a left part 147 of the length of the inside of the upper rail 103, towards the right side guide 111 and then extends downwardly through a first left opening 149 in the bottom of the upper rail. From the opening 149, the left guide cord 115 extends downwardly through or along the pleated blind material 107 and through a second left opening 151 in the top of the lower rail 105. Inside the lower rail 105, the left guide cord 115 is laced through the inner body end 137L of the left spring body 133L of the left cord tensioner 101L, and then, the left guide cord 115 extends to the right and generally parallel to the extension limiter 141L of the left cord tensioner 101L, towards the right side guide 111. From the open right end of the lower rail 105, the left guide cord 115 extends downwardly along, and to the rear of, a lower part of the right side guide 111 to the bottom thereof, where the left guide cord is attached by its bottom end 153 to a bottom right mounting block 129B.

The right guide cord 117 is routed as a mirror image of the left guide cord 115 through the blind 102. In this regard, a top end 155 of the right guide cord 117 is attached to the top of right side guide 111 by a top right mounting block 129T, then the right guide cord extends downwardly along the right side guide and then to the left into the open right end of the upper rail 103. Inside the upper rail 103, the right guide cord 117 extends to the left, along a right part 157 of the upper rail, towards the left side guide 109, until the right guide cord extends downwardly through a first right opening 159 in the bottom of the upper rail. Thereafter, the right guide cord 117 extends downwardly through or along the pleated blind material 107 and then into a second right opening 161 in the top of the lower rail 105. Inside the lower rail 105, the right guide cord 117 is laced through the inner body end 137R of the spring body 133R of the right cord tensioner 101R, and then, the right guide cord 117 extends to the left and generally parallel to the extension limiter 141R of the right cord tensioner 101R, towards the left side guide 109. From the open left end of the lower rail 105, the right guide cord 117 extends downwardly along, and to the rear of, a lower part of the left side guide 109 to the bottom thereof, where the right guide cord is attached by its bottom end 163 to a bottom left mounting block 131B.

Figure 4A:
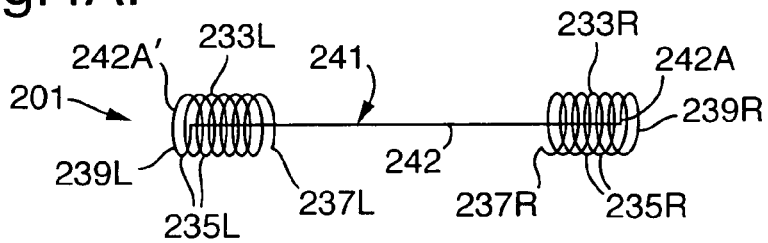
FIGS. 4A–4B are schematic views of second and third embodiments of the cord tensioner of this invention.

FIG. 4A shows a second embodiment 201 of the cord tensioner of the invention which is similar to the cord tensioner 1 of FIGS. 1 and 2 and for which corresponding reference numerals (greater by 200) are used below for describing the same parts or corresponding parts.

As shown in FIG. 4A, the cord tensioner 201 has left and right, coaxial, spring bodies 233L, 233R which are preferably helically-wound extension springs, each with a plurality of adjacent spring coils 235L, 235R. Each spring body 233L, 233R includes an inner body end 237L, 237R and an outer body end 239L, 239R. Between the outer body ends 239L, 239R of the two spring bodies 233L, 233R is an integrally formed extension limiter 241. The extension limiter 241 has a stem 242 that is an unwound length of the same spring wire material forming the spring bodies 233L, 233R. The stem 242 extends parallel to the axis of, preferably axially through, the spring bodies and their coils 235L, 235R. The stem 242 of the extension limiter 241, as shown in FIG. 4A, has a fixed left end 242L, attached to the outer body end 239L of the left spring body 233L. The stem 242 extends from the outer body end 239L: through the coils 235L of the left spring body 233L, then past its inner body end 237L, then past the inner body end 237R of the right spring body 233R, then through it's coils 235R, and then to its outer body end 239R, to which the right fixed end 242R of the stem 242 is attached. The extension limiter 241 thereby separates the two spring bodies 233L, 233R by a distance that is shorter than the maximum axial extension of either spring body.

The cord tensioner 201 is preferably mounted in a longitudinally-extending rail of a blind, so that the axis of its spring bodies 233L, 233R and its extension limiter 241L extend longitudinally. The cord tensioner 201 can, for example, be used in a blind 102 as shown in FIG. 3, where its outer body ends 239L, 239R would be mounted (e.g., with screws) on to, preferably in, the lower rail 105 of the blind 102. Thus the left guide cord 115 of the blind 102 would pull the inner body end 237L of the left spring body 233L longitudinally towards the inner body end 237R of the right spring body 233R along the extension limiter 241. The extension of the left spring body 233L would be limited by the inner body end 237R of the right spring body 233R. Similarly, the left guide cord 117 would pull the inner body end 237R of the right spring body 233R longitudinally towards inner body end 237L of the left spring body 233L along the extension limiter 241. Thus, the axial extension of each spring body 233L, 233R would be effectively limited by the opposite spring body 233R, 233L.

If the longitudinal distance between the spring bodies 233L, 233R of the cord tensioner 201 has to be longer than the maximum axial extension of the spring bodies along the extension limiter 241, separate cord tensioners 1, 101 of FIGS. 1–3 can be used instead of the cord tensioner 201. Alternatively, one or more blocking members (not shown) could be positioned at desired distances along the extension limiter 241, between the spring bodies 233L, 233R, as in the cord tensioner 301 of FIG. 4B.

Figure 4B:
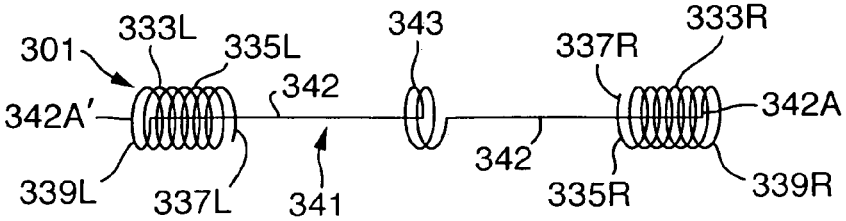

FIG. 4B shows a third embodiment 301 of the cord tensioner of the invention which is similar to the cord tensioner 201 of FIG. 4A and for which corresponding reference numerals (greater by 100) are used below for describing the same parts or corresponding parts.

The cord tensioner 301 has left and right, coaxial, spring bodies 333L, 333R which are preferably helically-wound extension springs, each with a plurality of adjacent spring coils 335L, 335R. The spring bodies each include an inner body end 337L, 337R and an outer body end 339L, 339R, and between the outer body ends 339L, 339R is an integrally formed extension limiter 341. The extension limiter 341 has a stem 342 that is an unwound length of the same spring wire material forming the spring bodies 333L, 333R. The stem 342 extends parallel to the axis of, preferably axially through, the spring bodies and their coils 335L, 335R. The stem 342 has a blocking member 343 that can be integrally formed with the stem by adding one or more extra coils on the stem between the spring bodies 333L, 333R. The transverse cross-section of the blocking member 343 must be larger than the transverse cross-section of the coils 335L, 335R of the spring bodies. The blocking member 343 should be larger in a direction transverse to the axis of the spring bodies than the cross-section of their coils 335L, 335R, transverse to the axis of the spring bodies.

The cord tensioners 1, 101, 202, 301 of the invention can be used in any conventional cord-guided blinds for many different types of windows without having to be redesigned. It may be necessary, for windows that are exceptionally steeply slanted and/or with bigger surfaces and/or for heavier blinds, to use a spring body 33, 133L, 133R, 233L, 233R, 333L, 333R that is bigger and stronger. It is of course well known that changes in diameter, number of windings, material used, etc. will result in different spring characteristics.

This invention is, of course, not limited to the above-described embodiments which may be modified without departing from the scope of the invention or sacrificing all of its advantages. In this regard, the terms in the foregoing description and the following claims, such as "axial", "vertical", "transverse", "longitudinal", "perpendicular", "upwardly", "downwardly", "inner", "outer", "right", "left", "front", "rear", "top", "bottom", "upper" and "lower", have been used only as relative terms to describe the relationships of the various elements of the cord tensioner for a cord-guided window covering of the invention as shown in the Figures.

For example, the blinds 2, 102 can be provided with one or more additional movable, longitudinally-extending rails and additional blind materials 7, 107, between the additional rails, and the guide cords 15, 17, 115, 117 can pass longitudinally through the additional rails to guide vertical movement of the additional rails within the blinds. Thereby, for example, a roller blind could be combined with a pleated blind in the same window, using a mutual intermediate bar. The pleated blind of such a composite blind could be cord guided, while the roller blind could be guided by side guides. The side guides for such a blind would preferably have a channel portion, and the free rims of the roller blind that are guided in the channel portion of the side guides could have side guiding pips preventing the roller blind material from escaping from the channel portions of the side guides. The roller blind could be at the top portion of the window and the pleated blind at the bottom. The blind at the top portion could also be a roller blind type insect screen.

Also, the cord tensioners 1, 101R, 101L, 201, 301 need not be at the upper or lower rail of the blind 2, 102 but could be at any additional longitudinally-extending rail of the blind.

The blinds 2, 102 could also be venetian blinds with guide cords perpendicular to their horizontal slats for guiding the slats when the blind is opened or closed.

Also, the rails 3, 5, 103, 105 of the blinds 2, 102 and any additional rails are not necessarily hollow but can be longitudinally-extending profiles that are open to front and/or back, such as a U-shaped profile or an I-shaped profile. The guide cords 15, 17, 115, 117 would then be routed along the open back of the rail profiles, and the cord tensioner(s) 1, 101R, 101L, 201, 301 could be attached to the back of the profiles. In this regard, although it is preferred that the cord tensioners are attached to an interior surface of the rails 3, 5, 103, 105 of the blinds 2, 102, the cord tensioners can be attached instead to an exterior surface of such rails or could even be closely adjacent to an exterior surface of such rails.

Furthermore, the cord-guided blind, in which the cord tensioners 1, 101R, 101L, 201, 301 are used, is not necessarily in a rectangular form. A blind for a triangular or a pentagonal shaped window could also be used, as long as the blind is a cord-guided blind.

I claim:

1. A cord-guided covering for an architectural opening which covering has a cord tensioner, a guide cord, an upper rail, a lower rail and a blind material extending between the upper and lower rails and in which the upper rail, the lower rail or both is movable along the guide cord; the cord tensioner being positioned at or near the upper or lower rail; and the cord tensioner comprising a helically wound, extension spring that includes a first, axially stretchable, spring body having a first end and a second end and an extension limiter to prevent the first spring body from being extended further axially than a predetermined length; wherein the extension limiter is integrally formed with the first spring body by establishing a stem having a fixed end at said second end of said spring body that passes completely through said spring body to a location spaced from said first end of said spring body and defining a terminal free end of said stem, and a blocking member on said free end for selective engagement with said first end of said spring body to limit expansion of said spring body.

2. The cord tensioner of claim 1, wherein the extension limiter is rigid.

3. The cord tensioner of claim 2, wherein the extension limiter is an uncoiled length of a spring wire material, from which the first spring body is also made.

4. The cord tensioner of claim 3 wherein the extension limiter extends parallel to the axis of the first spring body and has a length greater than the unstretched axial length of the first spring body and thus extends beyond the axial length of the first spring body.

5. The cord tensioner of claim 4 wherein the extension limiter extends axially through the first spring body.

6. The cord tensioner of claim 1, wherein the extension limiter is an uncoiled length of a spring wire material, from which the first spring body is also made.

7. The cord tensioner of claim 6 wherein the extension limiter extends parallel to the axis of the first spring body and has a length greater than the unstretched axial length of the first spring body and thus extends beyond the axial length of the first spring body.

8. The cord tensioner of claim 7 wherein the extension limiter extends axially through the first spring body.

9. The cord tensioner of claim 8 wherein the extension limiter extends parallel to the axis of the first spring body and has a length greater than the unstretched axial length of the first spring body and thus extends beyond the axial length of the first spring body.

10. The cord tensioner of claim 9 wherein the extension limiter extends axially through the first spring body.

11. The cord tensioner of claim 1 wherein the extension limiter extends parallel to the axis of the first spring body and has a length greater than the unstretched axial length of the first spring body and thus extends beyond the axial length of the first spring body.

12. The cord tensioner of claim 11 wherein the extension limiter extends axially through the first spring body.

13. The cord tensioner of claim 1 wherein the extension limiter extends axially through the first spring body.

14. A cord-guided covering for an architectural opening which covering has a cord tensioner, a guide cord, an upper rail, a lower rail, and a blind material extending between the upper and lower rails and in which the upper rail, the lower rail, or both is movable along the guide cord; the cord tensioner being positioned at or near the upper or lower rail; and the cord tensioner comprising a helically wound extension spring that includes a first axially stretchable spring body and an extension limiter to prevent the first spring body from being extended further axially than a predetermined length; wherein the extension limiter is integrally formed with the first spring body, and a second spring body that is axially spaced away from the first spring body by the extension limiter and is also integral with the extension limiter; and wherein each spring body acts as a blocking member for the opposite spring body.

15. The cord tensioner of claim 14 wherein the extension limiter extends parallel to the axis of the second spring body and has a length greater than the unstretched axial length of the first and second spring bodies.

16. The cord tensioner of claim 15 wherein the extension limiter extends axially through the first and second spring bodies.

17. A covering for an architectural opening which includes an upper rail, a lower rail and a blind material extending between the upper and lower rails and in which the upper rail, the lower rail or both are movable; the blind further including at least one cord for guiding the blind material when the blind is opened or closed and the guide cord being tensioned by a cord tensioner of claim 14.

18. A cord-guided covering for an architectural opening which covering has a cord tensioner, a guide cord, an upper rail, a lower rail, and a blind material extending between the upper and lower rails and in which the upper rail, the lower rail, or both is movable along the guide cord; the cord tensioner being positioned at or near the upper or lower rail; and the cord tensioner comprising a helically wound extension spring that includes a first axially stretchable spring body and an extension limiter to prevent the first spring body from being extended further axially than a predetermined length; wherein the extension limiter is integrally formed with the first spring body, and a second spring body that is axially spaced away from the first spring body by the extension limiter and is also integral with the extension limiter; and wherein each spring body acts as a blocking member for the opposite spring body.

19. The cord tensioner of claim 18 wherein the extension limiter extends parallel to the axis of the second spring body and has a length greater than the unstretched axial length of the first and second spring bodies.

20. The cord tensioner of claim 19 wherein the extension limiter extends axially through the first and second spring bodies.

21. A covering for an architectural opening which includes an upper rail, a lower rail and a blind material extending between the upper and lower rails and in which the upper rail, the lower rail or both are movable; the blind further including at least one cord for guiding the blind material when the blind is opened or closed and the guide cord being tensioned by a cord tensioner of claim 18.

* * * * *

UNITED STATES PATENT AND TRADEMARK OFFICE

CERTIFICATE OF CORRECTION

PATENT NO. : 7,216,687 B2
APPLICATION NO. : 10/970896
DATED : May 15, 2007
INVENTOR(S) : Johannes Robertus Maria Franssen It is certified that error appears in the above-identified patent and that said Letters Patent is hereby corrected as shown below:

Col. 9, Claim 18, line 15, after ";" delete "and";
line 15, delete "each spring body acts as" and insert --the extension limiter has--; and
line 16, delete "for the opposite" and insert --between the two-- and
line 16, delete "body" and insert --bodies--.

Signed and Sealed this

Nineteenth Day of June, 2007

JON W. DUDAS
*Director of the United States Patent and Trademark Office*